US005622370A

United States Patent [19]

D'Andrade

[11] Patent Number: 5,622,370

[45] Date of Patent: Apr. 22, 1997

[54] WATER LIMBO BAR AMUSEMENT DEVICE

[76] Inventor: Bruce M. D'Andrade, 3 Ten Eyck Rd., Readington Township, Hunterdon County, N.J. 08870

[21] Appl. No.: 672,934

[22] Filed: Jun. 28, 1996

[51] Int. Cl.[6] ..... A63B 71/04; A63B 1/00

[52] U.S. Cl. ..... 273/449; 482/17

[58] Field of Search ..... 273/440, 444, 273/449, 459; 482/17, 81

[56] References Cited

U.S. PATENT DOCUMENTS

| | | | |
|---|---|---|---|
| 3,294,400 | 12/1966 | Goldstein | 482/17 X |
| 3,326,551 | 6/1967 | Clarke . | |
| 3,481,600 | 12/1969 | Lang, Sr. et al. . | |
| 3,801,096 | 4/1974 | Miller | 273/449 |
| 5,120,077 | 6/1992 | Belli | 273/459 X |
| 5,480,333 | 1/1996 | Blanchard . | |

OTHER PUBLICATIONS

Encyclopedia American, p. 485, vol. 17; Grollier, Inc., 1991.

*Primary Examiner*—Paul E. Shapiro
*Attorney, Agent, or Firm*—Kenneth P. Glynn, Esq.

[57] ABSTRACT

A water limbo bar amusement device has a base for supporting vertical support poles. A height adjustment mechanism is frictionally connected to the vertical support poles and a water distribution and spraying unit is in turn connected to the height adjustment mechanism. A limbo bar is rotatably connected to the water distribution and spraying unit and also has a twistable triggering mechanism for actuating the water release mechanism, which releases pressurized water from a chamber to a set of nozzles and rotating fins, thereby getting the user wet. A water release housing has an inlet and an exit port from the chamber. There is a snap action water release mechanism in the water release housing. Upon twisting of the limbo bar, the twistable trigger moves a slidably connected valve body away from the exit port, presses a release pin, and opens a first pressure valve. This causes a decrease in the pressure permitting a second pressure valve to open. The opening of the second pressure valve results in channeling the water into the exit port, through a water distribution bar and out through the nozzles and rotating fins.

20 Claims, 4 Drawing Sheets

WATER LIMBO BAR AMUSEMENT DEVICE

BACKGROUND OF THE INVENTION

1. Field of the Invention

The present invention is a water limbo bar amusement device. Specifically, it is directed to an amusement game or toy which sprays water upon an user who fails to clear the limbo bar, thereby activating the snap action water release mechanism. More specifically, the present invention is directed to devices which use pressurized fluid chambers and snap action release mechanisms for the forceful and quick release of the pressurized fluid through nozzles and onto the user.

2. Information Disclosure Statement

Amusement games and toys which use water as a basic ingredient for fun have been around for years. Among the popular devices are water guns, various types of water slides, and water related hoop toys.

The following U.S. patents and other literature represent items related to the present invention and represents the state-of-the-art in this field:

The Encyclopedia Americana describes the limbo as a dance originating in the West Indies, where the dancer, in a backward bent position, passes under a horizontally supported stick without touching it. After each round, the height of the stick is progressively lowered, requiring more stamina and balance on the part of the dancer. Many individuals may compete in the dance, which is normally accompanied by heavy rhythmic music. It is featured in nightclubs with audience participation.

U.S. Pat. No. 5,480,336 to Blanchard is for a water construction kit which includes a plurality of elongated tubular elements and mating connectors, which elements and connectors provide for the flow of water therethrough. The connectors may include shutoff valves therein to provide selective control of water flowing through the individual tubes.

U.S. Pat. No. 3,326,551 to Clarke is an invention related to water driven toys, and in particular, it is a water driven hoop adapted to rotate while providing a water spray in the plane of the hoop so that a person may jump through the hoop and through a sheet of water. It consists of a tubular hoop with fine spray holes, a stand for supporting the hoop, means for connecting the hoop to the stand.

U.S. Pat. No. 3.481,600 to Lang for a water actuated jump rope. Pressurized fluid is directed through apertures formed in the wall of the hose, where the apertures are disposed generally horizontal when the hose is hanging downwardly. The release of the fluid from the apertures creates a generally tangential force to cause rotation of the jump rope.

Notwithstanding the above-cited prior art, the present invention is neither taught nor rendered obvious thereby.

SUMMARY OF THE INVENTION

The present invention is a water limbo bar amusement device. As in the traditional game, a person attempts to go under the limbo bar without hitting or knocking off the limbo bar from its support structure. The goal being to see who can go under the bar as the height of the limbo bar is lowered relative to the ground. In the traditional game, if the user knocks the bar of off its support structure, nothing happened except that the person was possibly disqualified from any further attempts. In the water limbo bar game, when a person hits the bar, a snap action water release mechanism is triggered, releasing the pressurized water, and spraying the water onto the person.

The water limbo bar amusement device has a support structure, a height adjustment mechanism, a water distribution unit, a limbo bar and a snap action water release mechanism. The support structure consists of a pair of vertical support poles which reside in a pair of corresponding base units. A height adjustment mechanism is frictionally connected to the vertical support poles so that the height of the limbo bar can be easily adjusted as required.

A water distribution unit is also connected to the height adjustment mechanism. The water distribution unit consists of a hollow, horizontal bar, a plurality of nozzles and a cooperating plurality of rotating fins. The plurality of nozzle units and rotating fins are spaced equally along the length of the horizontal bar. In addition, a pair of end units are attached to the distribution bar. Optionally, there may be a plurality of holding posts corresponding to the number of rotating fins and end units. These may be used to support the rotating fins and/or could be used for decorative purposes.

The limbo bar is rotatably connected to the end units via a pair of arms. More specifically, the limbo bar is circularly connected via a thread type ramping connection to a snap action water release mechanism such that when the user hits the limbo bar it twists a distribution bar, which in turn actuates the release mechanism. The snap action water release mechanism is located at one end of the distribution bar and has an inlet for the water source. The snap action water release mechanism has a first valve which, when released, causes a decrease in pressure to cause a second valve to open. The opening of the second valve releases pressurized water through the exit port, into the distribution unit, out the nozzle holes, through the fins, rotates the fins and splashes water onto the user.

BRIEF DESCRIPTION OF THE DRAWINGS

The present invention should be more fully understood when the specification herein is taken in conjunction with the drawings appended hereto where in.

DETAILED DESCRIPTION OF THE PRESENT INVENTION

The present invention is a water limbo bar amusement game or toy. Traditionally, a person attempts to go under the limbo bar without hitting or knocking off the limbo bar, which is either suspended between opposing support structures or is held horizontally a predetermined height above the ground. The goal of the dance was to determine which individual had the best stamina and flexibility by seeing who could go under the limbo bar as the height of the limbo bar was progressively decreased.

The water limbo bar amusement device adds the fun of water to the game, making it appealing to adults and, more importantly children. The present invention toy utilizes a water pressurized chamber and a snap action release mechanism. The chamber is initially pressurized using an external water source and the limbo bar is set in a rest state. The snap action release mechanism is actuated when the user hits the limbo bar. Hitting the limbo bar results in twisting the distribution bar, which in turn causes the snap action release to trigger. The pressurized water is then channeled to the distribution bar, let out through the spinning fins or blades and waters down the user.

Figure 1:
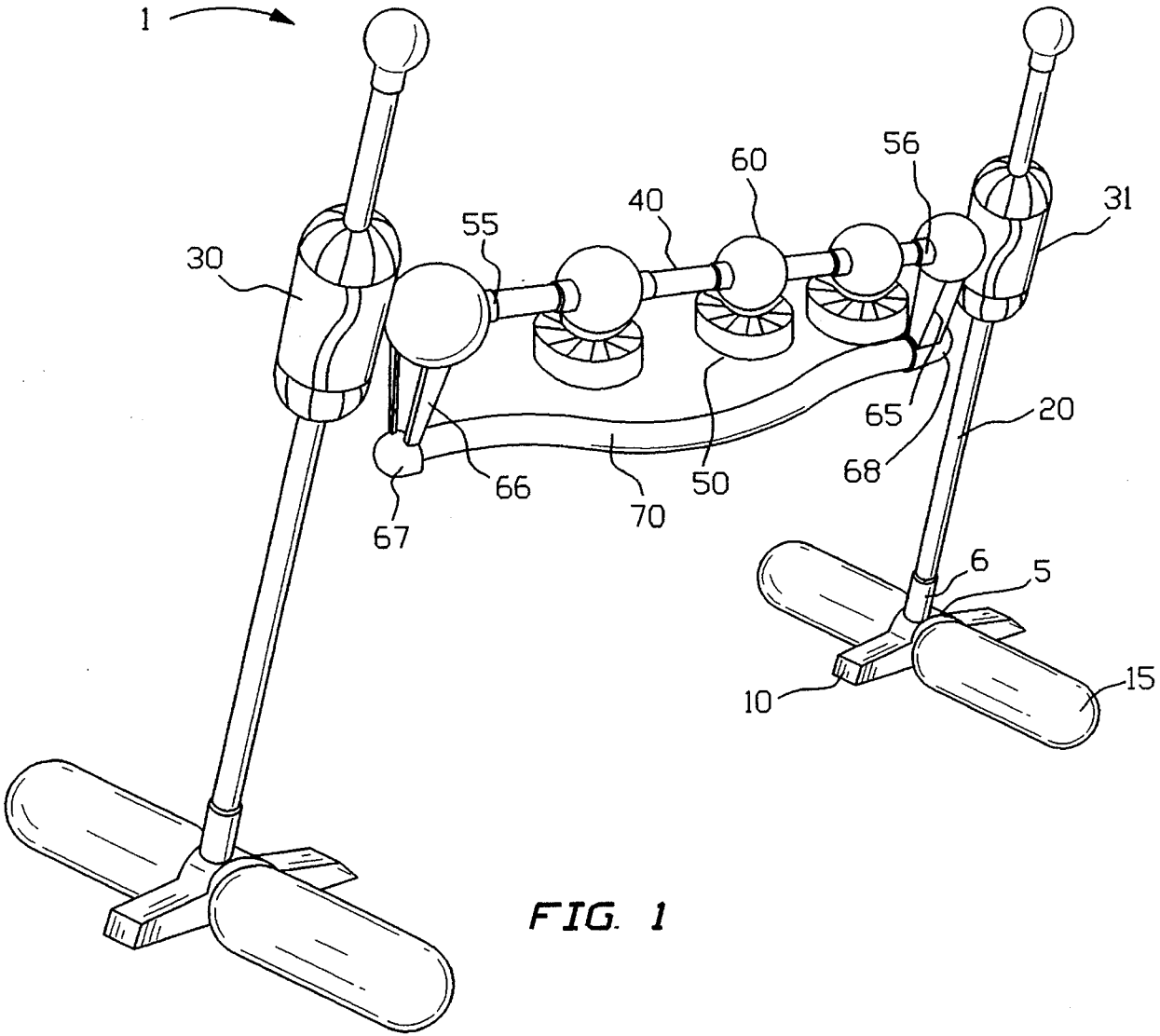
FIG. 1 is a perspective view of an embodiment of the present invention.
Figure 4:
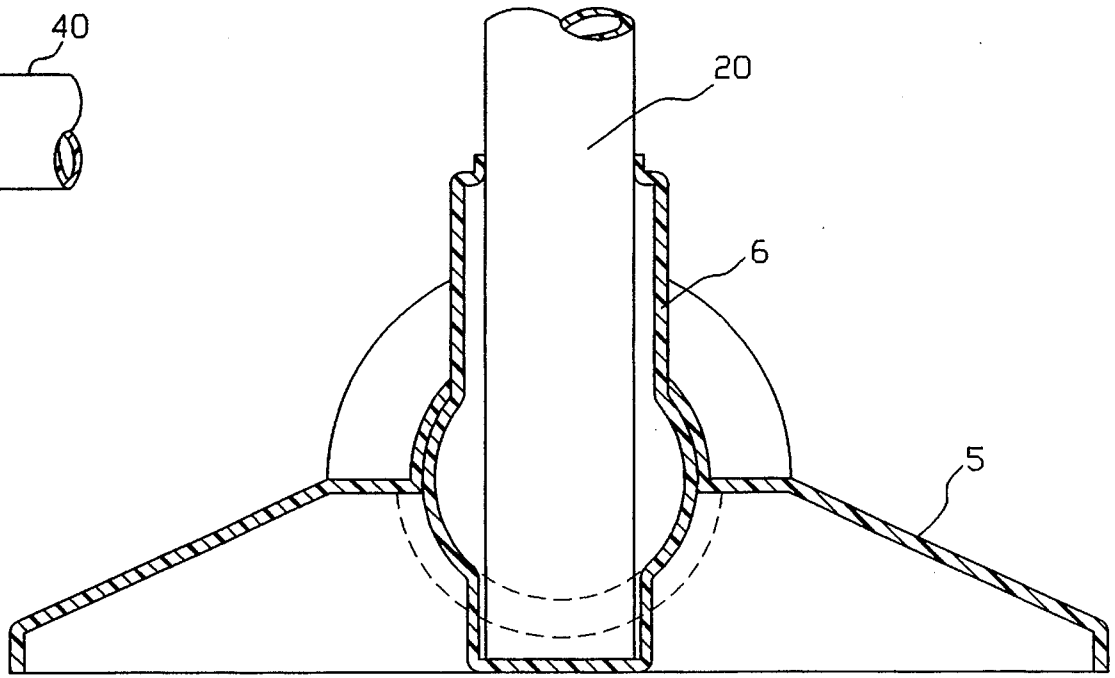
FIG. 4 shows a cross sectional side view of an embodiment of the base of the present invention.
Figure 5:
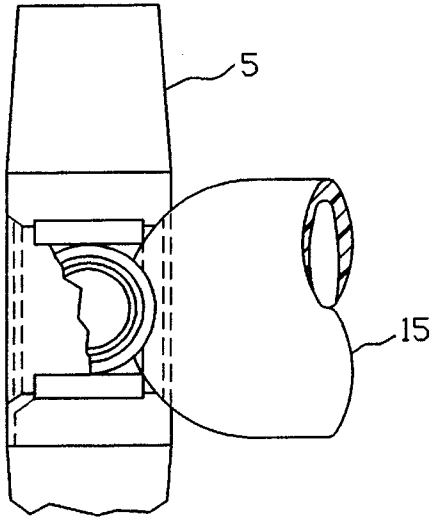
FIG. 5 shows a top view of the base of the present invention shown in FIG. 4.
Figure 6:
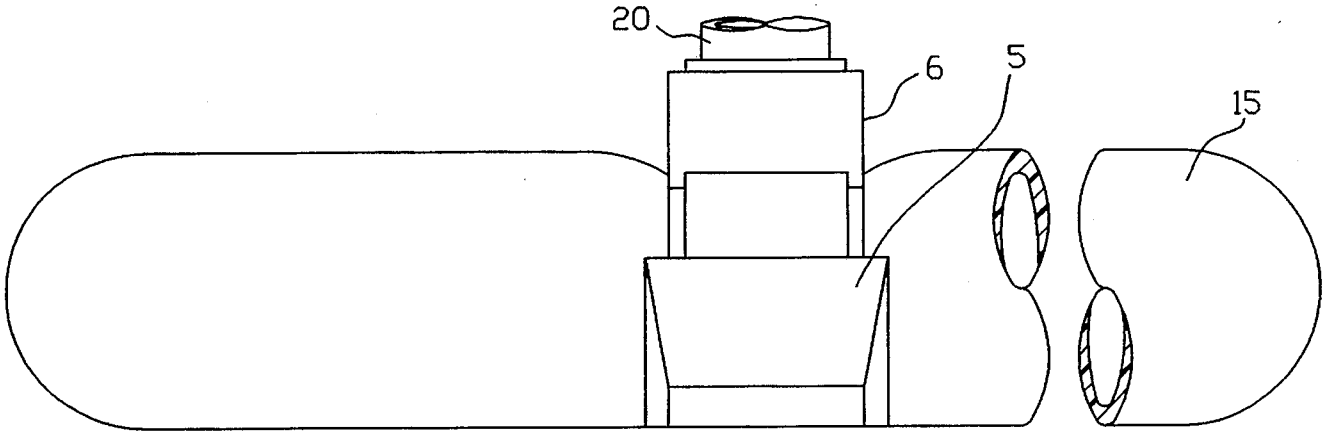
FIG. 6 shows a side view of the base of the present invention shown in FIG. 5.

Referring to FIG. 1, an embodiment of the present invention device is shown and is depicted generally as 1. Device 1 is generally composed of a pair of bases 5, a height adjustment device 30, 31, a water distribution unit, a limbo bar 70 and a snap action water release mechanism 74. Referring now also to FIGS. 4–6, each base 5 has a pair of opposing wing supports 10, a pair of balance supports 15, and a neck support 6. Each pair of opposing wing supports 10 and balance supports 15 are positioned so as to form a plus configuration. The plus configuration provides a stable platform for supporting the rest of device 1. Within each neck support 6 of base 5 is disposed a vertical support pole 20. The remaining structure of device 1 is suspended between vertical support poles 20. Balance supports 15, wing supports 10, neck support 6 are generally made from molded plastic. Vertical support poles 20 are hollow tubes and are generally constructed from extrudable plastics.

Figure 2:
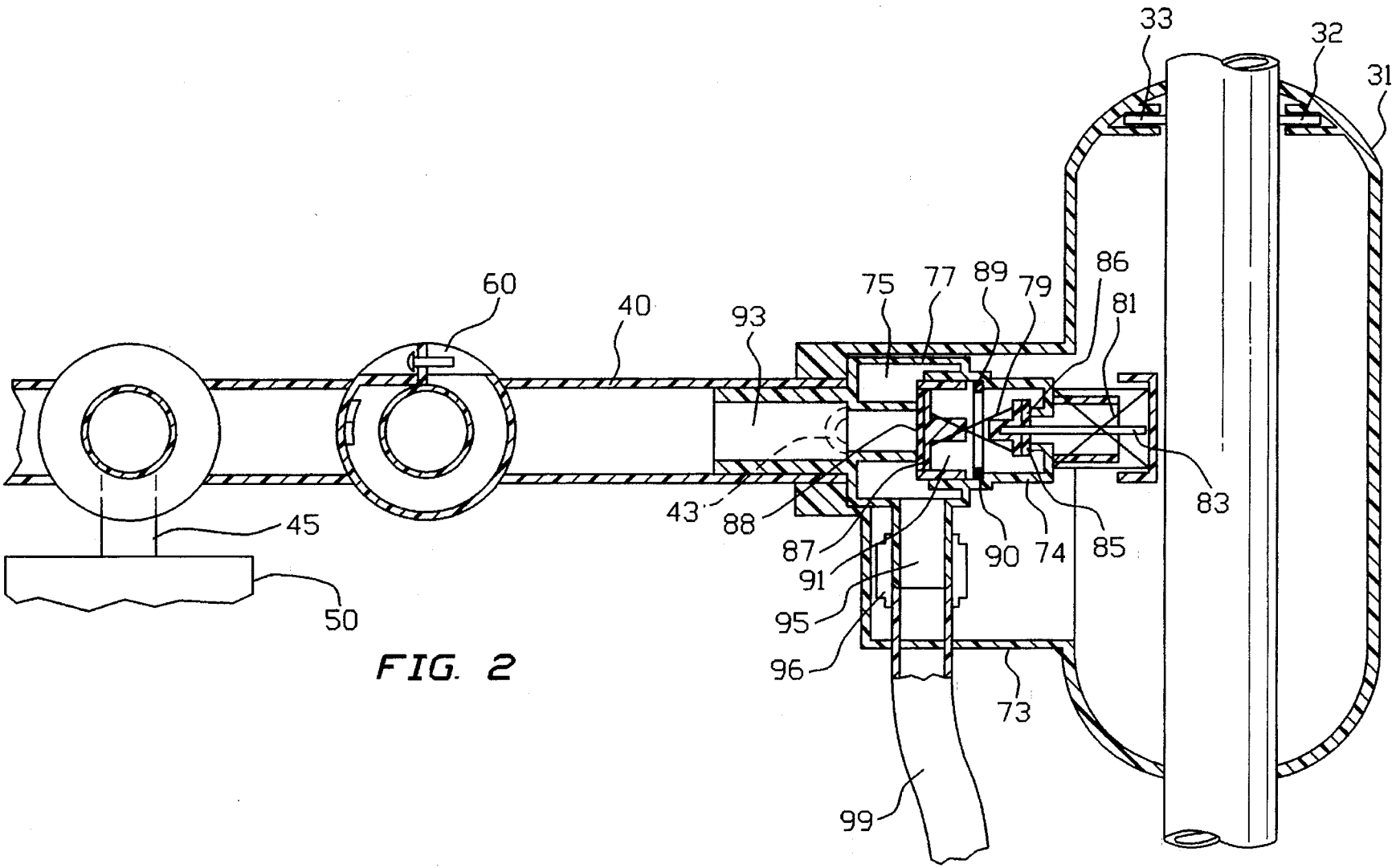
FIG. 2 shows a side cross-sectional view of an embodiment of the release mechanism for the present invention.
Figure 3:
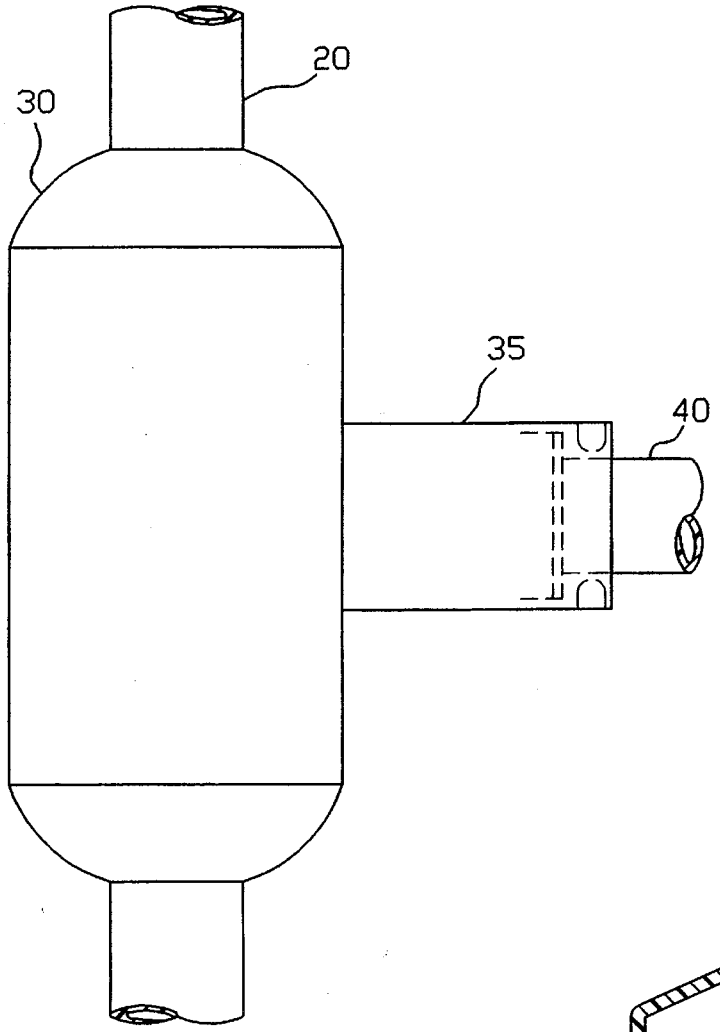
FIG. 3 shows an embodiment of the advancement mechanism for the present invention.

Referring now also to FIGS. 2 and 3, a height adjustment mechanism 30, 31 is frictionally connected to vertical support poles 20 so that the height of limbo bar 70 can be easily adjusted as required. Referring specifically to FIG. 2, frictional attachment of height adjustment mechanism 30, 31 to vertical support poles 20 is accomplished by using friction posts 32, 33, which are disposed within height adjustment mechanism 30, 31. Height adjustment mechanism 30, 31 are nominally hollow bulbous containers and are generally molded or blown plastic.

Referring also to FIG. 3, the water distribution unit is also connected to height adjustment mechanism 30, 31. The water distribution unit consists of a hollow, horizontal distribution bar 40, a plurality of nozzles 45 and a cooperating plurality of rotating fins 50. Distribution bar 40 is connected to height adjustment mechanism 30, 31 via extension neck 35 and release housing 73. In addition, a pair of end units 55, 56 are attached to distribution bar 40. Plurality of nozzles 45 and rotating fins 50 are spaced equally apart at predetermined intervals along the length of distribution bar 40. Nozzles 45 are implemented such that a liquid can pass from distribution bar 40 to rotating fins 50. In this sense, nozzles 45 are meant to include perforations, if any, in distribution bar 40. Alternatively, nozzles 45 could include hollow T-bar junctions, whereby distribution bar 40 is constructed from a set of smaller hollow tubes and connected to the T-bar junctions. Rotating fins 50 are connected to nozzles 45 such that the force and direction of the liquid causes rotating fins 50 to spin when snap action water release mechanism 74 is actuated and the pressurized water hits rotating fins 50. Optionally, there may be a plurality of holding posts 60 corresponding to the number of rotating fins 50 and end units 55, 56. Holding posts 60 can be used to support rotating fins 50 and end units 55, 56 and provides an aesthetically pleasing decorative touch to device 1.

Limbo bar 70 is circularly, switchably connected to distribution bar 40 via arms 65, 66. More specifically, limbo bar 70, at at least one end of distribution bar 40, is circularly connected via a thread type, ramping connection 43 such that when an user hits limbo bar 70, it twists distribution bar 40 which in turn moves a valve body 77 in an unbiased direction, which in FIG. 2 is to the right. This actuates snap action water release mechanism 74, resulting in spraying water upon the user. The degree of rotation is nominally approximately 15°, but can be higher or lower dependent upon the activating mechanism used. Limbo bar 70 is nominally manually reset after snap action water release mechanism 74 has been actuated. However, it can have an automatic reset feature. Arms 65, 66 have end caps 67, 68 for placement of limbo bar 70. Limbo bar 70 can be a foam covered extruded hollow tube or any other such device, which will not injure the user when attempting to use device 1. It is preferably covered with a water proof or resistant material.

Snap action water release mechanism 74 is located within a release housing 73 situated at one end of distribution bar 40. Release housing 73 has an inlet port 95 for connecting up an external source of water, i.e. a hose 99 via a connector 96 and has an exit port 93, which channels water to distribution bar 40 from a chamber 75. Snap action water release mechanism 74 is a double action mechanism in that the opening of a first pressure release valve 85 causes the opening of a second pressure release valve 87, resulting in the sudden and forceful rapid decompression of the pressurized portions of chamber 75 and channeling of the water through distribution bar 40, out rotating fins 50 and onto the user.

Release housing 73 includes a valve body 77 which is connected to inlet port 95 and exit port 93. In a rest or unactuated state, valve body 77 is biased to the left by first spring 81. Snap action release mechanism 74 is defined by first valve 85, second valve 87 and an inner chamber 91. First valve 85 and second valve 87 have rubber seals 86 and 88, respectively, to help seal and maintain pressure levels. In a rest state, first valve 85 and second valve 87 are biased closed via second spring 79, i.e. they do not permit water to go in exit port 93. Note that first valve 85 and second valve 87 are in linear alignment.

Assuming that chamber 75 is pressurized with a liquid, twisting of limbo bar 70 moves valve body 77 in the unbiased direction (to the right in FIG. 2) and compresses first spring 81. As a result, a valve pin 83 is pressed and opens first valve 85. This causes compressed liquid to exit from the pressurized portions of inner chamber 91 to a slight degree, i.e. in result of the limited amount that first valve 85 is open. The decompression causes an inward pull (to the right) on second valve 87 to open it and move away from exit port 93. Second valve 87 moves to the right until o-ring seals 89, 90 are compressed so as to form an inner seal in an upper portion of inner chamber 91 and effectively channel the pressurized liquid through exit port 93, to distribution bar 40, out rotating fins 50 and finally onto the offending user. As stated before, after actuation, limbo bar 70 is manually reset to bias valve body 77, first valve 85 and first valve 87. In an alternative embodiment, limbo bar 70 automatically resets for the next use.

The construction of the present invention device is, typically, of various types of plastic and, once the invention is appreciated, the selection of soft and hard plastics for various components will be within the scope of the artisan. For example, high density polyethylene may be used for certain aspects of the invention, whereas hard rubber could be used for other components. Additional types of materials typically used in the construction of these devices include rigid and flexible foams, metals, and graphite.

Obviously, numerous modifications and variations of the present invention are possible in light of the above teachings. It is therefore understood that within the scope of the appended claims, the invention may be practiced otherwise than as specifically described herein.

What is clamied is:

1. A water limbo bar amusement device, which comprises:

a) means for supporting a pair of vertical support poles;

b) means for frictionally connecting a height adjustment mechanism to said pair of vertical support poles;

c) means for connecting a water distribution and spraying unit to said height adjustment mechanism;

d) means for rotatably connecting a limbo bar to said water distribution and spraying unit;

e) said means for rotatably connecting having means for twistably triggering a slidably connected valve body which actuates a mechanism for releasing pressurized water from a chamber to said water distribution and spraying unit;

f) a release housing positioned at one end of said water distribution and spraying unit; and g) said release housing, comprising:

1) means for inletting pressurized water into said chamber;

2) an exit port for channeling said pressurized water from said chamber to said water distribution and spraying unit;

3) first means for biasing said slidably connected valve body such that a second pressure valve is sealably closed against said exit port;

4) a valve pin slidably maintained with respect to said slidably connected valve body and with a first pressure valve;

5) said mechanism for releasing pressurized water being defined within said release housing and connected to said valve body and said valve pin, comprising:

i) an inner chamber defined by said first pressure valve, and said second pressure valve;

ii) said second pressure valve being slidable within said inner chamber to isolate said inner chamber from said chamber, said inner chamber containing a quantity of water;

iii) second means within said inner chamber for biasing said second pressure valve into sealing engagement with said exit port and for biasing said first pressure valve into sealing engagement with an inner chamber outlet corresponding to a position of said valve pin;

iv) said first pressure valve being openable by actuation of said limbo bar, whereby upon twisting of said limbo bar, said twistable trigger moves said slidably connected valve body away from said exit port, presses said valve pin and opens said first pressure valve, allowing said pressurized water to exit said inner chamber and causing a pressure decrease within said inner chamber, said pressure decrease being sufficient to overcome said first biasing means and said second biasing means by drawing said second pressure valve away from said exit port and causing formation of an inner seal with a pair of o-rings so as to channel said pressurized water through said exit port to said water distribution and spraying unit.

2. The device of claim 1, wherein said first pressure valve is located in linear alignment with said second pressure valve and arranged such that when said first pressure valve is opened and causes a pressure drop within said inner chamber, the change in pressure within said inner chamber causes a movement of said second pressure valve from a closed position against said exit port to an open position toward said first pressure valve.

3. The device of claim 2, wherein said means of supporting further includes:

a) a pair of wing supports for each of said pair of vertical support poles;

b) a pair of balance supports for each of said pair of vertical support poles;

c) a neck support for each of said pair of vertical support poles; and d) means for positioning said pair of wing supports and said pair of balance supports in a plus configuration so as to provide a stable platform.

4. A device as claimed in 3, wherein said water distribution and spraying unit further comprises:

a) a horizontal distribution bar;

b) a plurality of nozzles disposed on said horizontal distribution bar; and c) a plurality of rotating fins connected to each of said plurality of nozzles.

5. A device as claimed in 4, wherein said means for rotatably connecting further comprises:

a) a pair of end units disposed on said horizontal distribution bar; and b) a pair of arms for connecting said limbo bar to said horizontal distribution bar.

6. A device as claimed in claim 5, wherein said water distribution and spraying unit further comprises a plurality of holding posts for supporting said plurality of nozzles, said plurality of rotating fins and said pair of end units.

7. A water limbo bar amusement device, which comprises:

a) vertical support means;

b) bases to support said vertical support means c) a height adjustment mechanism frictionally connected to said vertical support means;

c) a horizontal pole;

d) means for attaching said horizontal pole to said vertical support means;

e) a water control valve having an inlet side connected to a pressurized water supply;

f) said water control valve having an outlet port connected to said horizontal pole; and g) an actuating trigger for activating said water control valve, wherein said pressurized water is sprayed from said horizontal pole when said actuating trigger activates said water control valve.

8. The device of claim 7, wherein said water control valve has a first pressure valve located in linear alignment with a second pressure valve and arranged such that when said first pressure valve is opened, a pressure drop within an inner chamber occurs, said pressure drop within said inner chamber causes a movement of said second pressure valve from a closed position against said outlet port to an open position toward said first pressure valve.

9. The device of claim 7, wherein said bases further includes:

a) wing support means for said vertical support means;

b) balance support means for said vertical support means; and c) neck support means said vertical support means.

10. The device of claim 9, wherein said wing support means and said balance support means are placed in a plus configuration so as to provide a stable platform.

11. A device as claimed in 10, wherein said horizontal pole further comprises:

a) a plurality of nozzles disposed on said horizontal pole; and b) a plurality of rotating fins connected to each of said plurality of nozzles.

12. A device as claimed in claim 11, wherein said actuating trigger is a limbo bar.

13. A device as claimed in claim 12, wherein said horizontal pole further comprises a plurality of holding posts for supporting said plurality of nozzles, and said plurality of rotating fins.

14. A water limbo bar amusement device, which comprises:

a) a water control device having an inlet port and an outlet port, comprising:

i) a flow valve biased to a closed position for controlling a flow of water to said exit port;

ii) a control valve functionally connected to said flow valve such that said control valve causes a reduction in pressure in a chamber connected to said flow valve, causing said flow valve to snap open;

b) a distribution system for water from said exit port of said water control device;

c) means for supporting said water control device and said distribution system;

d) a height adjustment mechanism connected to said distribution system; and e) triggering means for opening said control valve.

15. A device as claimed in claim 14, wherein said flow valve and said control valve each have a rubber seal.

16. A device as claimed in claim 15, wherein said flow valve is located in linear alignment with said control valve and arranged such that when said control valve is opened and causes a pressure drop within said chamber, the change in pressure within said chamber causes a movement of said flow valve from a closed position against said exit port to an open position toward said control valve.

17. The device as claimed in claim 16, wherein said means for supporting includes:

a) a pair of vertical support poles;

a) a pair of wing supports for each of said pair of vertical support poles;

b) a pair of balance supports for each of said pair of vertical support poles; and c) a neck support for each of said pair of vertical support poles.

18. The device of claim 17, wherein said pair of wing supports and said pair of balance supports are placed in a plus configuration so as to provide a stable platform.

19. A device as claimed in 18, wherein said distribution system further comprises:

a) a distribution bar;

b) a plurality of nozzles disposed on said distribution bar; and c) a plurality of rotating fins connected to each of said plurality of nozzles.

20. A device as claimed in 19, wherein said triggering means is a limbo bar.

* * * * *